US005705272A

United States Patent [19]

Taniguchi

[11] Patent Number: 5,705,272

[45] Date of Patent: Jan. 6, 1998

[54] HEATING MEMBER AND HEAT FIXING APPARATUS USING THE SAME

[75] Inventor: Yasushi Taniguchi, Kawasaki, Japan

[73] Assignee: Canon Kabushiki Kaisha, Tokyo, Japan

[21] Appl. No.: 426,178

[22] Filed: Apr. 21, 1995

[30] Foreign Application Priority Data

Apr. 25, 1994 [JP] Japan ..... 6-086404

[51] Int. Cl.[6] ..... G03G 15/20

[52] U.S. Cl. ..... 428/408; 219/548; 219/553; 428/426; 428/698; 428/701; 428/702

[58] Field of Search ..... 428/408, 698, 428/701, 702, 426; 430/66, 67; 219/543, 200, 481, 546, 548, 552, 553; 432/120

[56] References Cited

U.S. PATENT DOCUMENTS 4,783,369 11/1988 Sugata et al. ..... 428/408
4,840,388 6/1989 Sugata et al. ..... 219/543
4,898,798 2/1990 Sugata et al. ..... 430/66
5,155,340 10/1992 Morita ..... 219/543
5,168,023 12/1992 Mitani et al. ..... 430/66
5,240,801 8/1993 Hayashi et al. ..... 430/67
5,350,720 9/1994 Kawada et al. ..... 219/553
5,352,523 10/1994 Zurecki et al. ..... 428/408
5,368,939 11/1994 Kawamura et al. ..... 428/408

*Primary Examiner*—Archene Turner
*Attorney, Agent, or Firm*—Fitzpatrick, Cella, Harper & Scinto

[57] ABSTRACT

A heating member having a lubricating and protective layer on the surface thereof, wherein the lubricating and protective layer is a vapor deposited layer which is made of carbon or the main component of which is carbon; and the lubricating and protective layer is formed on a separation-preventive layer for preventing separation of the lubricating and protective layer. The heating member according to the present invention for use in a heat fixing apparatus enables the heat fixing apparatus to maintain excellent wear resistance and sliding characteristics for a long time. Furthermore, the fixing speed can be raised and the size of an image that can be fixed can be enlarged, and thus the running cost can be reduced.

7 Claims, 9 Drawing Sheets

HEATING MEMBER AND HEAT FIXING APPARATUS USING THE SAME

BACKGROUND OF THE INVENTION

1. Field of the Invention

The present invention relates to a heating member and a heat fixing apparatus for use in an image forming apparatus, such as a copying machine or a laser beam printer, to fix a pre-fixed image with heat.

2. Related Description of the Background Art

As a heating member and a heat fixing apparatus using the same, a heating apparatus has been disclosed in Japanese Patent Laid-Open No. 63-313182 which comprises a fixing heater and a thin film that slides along the heater.

FIGS. 1 and 2 are schematic diagrams of a heater of the foregoing type. The heater 1 comprises an electrically insulating, heat resisting and elongated substrate 2 having a low heat capacity; a straight and elongated heat-generating resistor 3 formed in the widthwise direction of the central portion of either side (on the upper surface) of the substrate 2 to run along the lengthwise direction of the substrate 2; electrode terminals (connection terminals) 4 and 5 formed on the surface of the substrate 2 while being respectively electrically connected to the two ends of the heat-generating resistor 3; an insulating protective film 6 made of glass or the like having electric insulating characteristic to serve as a layer for protecting the surface of the heater 1 by covering the surface of the heat-generating resistor 3; and a temperature detecting device 7 comprising a thermistor or the like and disposed on another side (on the rear side) of the substrate 2. The substrate 2 is, for example, a ceramic plate made of $Al_2O_3$, AlN, SiC or the like and having a width of 10 mm, a thickness of 1 mm and a length of 240 mm. The heat-generating resistor 3 is, for example, a patterned layer having a thickness of 10 μm and a width of 1 mm, and formed by, in the atmosphere, baking Ag/Pd (an alloy of silver and palladium), $RuO_2$, $Ta_2N$ or the like applied by screen printing or the like. The electrode terminals 4 and 5 usually are patterned layers each of which has a thickness of 10 μm and which are formed by, in the atmosphere, baking Ag applied by screen printing or the like. Usually, electric wires are connected to the electrode terminals 4 and 5 by connectors (not shown) to supply electric power.

The heater 1 has a structure such that the widthwise region of a fixing nip portion 15 (a contact nipping portion or a pressurizing portion) is positioned in the substantially central portion of the heat-generating resistor 3 in order to control and restrict the temperature of the fixing surface of the heater 1. The surface of the heater 1 facing the insulating protective film 6 is the surface with which a thin film comes in contact and along which the same slides. The heater 1 is, between the two electrode terminals 4 and 5 of the heat-generating resistor 3 thereof, supplied with voltage from an AC power source 12 to cause the heat-generating resistor 3 to generate heat so that the temperature of the heater 1 is raised.

The temperature of the heater 1 is detected by the temperature detecting device 7 disposed on the rear side of the substrate 2 so that information indicating the result of the detection is fed back to a control circuit. Thus, supply of electric power from the AC power source 12 to the heat-generating resistor 3 is controlled so that the temperature of the heater 1 is controlled to a predetermined level. The temperature detecting device 7 of the heater 1 is disposed on the fixing surface at which the most excellent heat response can be attained, that is, at a position on the rear side of the substrate 2 (at a position on the rear side of the substrate 2 right under the heat-generating resistor 3) corresponding to the heat-generating resistor 3 disposed on the outer surface of the substrate 2 of the heater 1.

To fix a pre-fixed image, heat of the heater 1 is conducted through the insulating protective film 6 and the film contact and sliding surface. However, abrasion between the insulating protective film 6 and the film contact and sliding surface causes the film to be worn excessively if the length of the contact and sliding reaches about 60 km. Wear dust generated from the worn film non-uniformly adheres to the roller that moves the film, thus causing the speed at which the film is moved to be made irregular. As a result, there arises a problem in that a pre-fixed image cannot be fixed uniformly. The glassy layer for use in the insulating protective film 6 is manufactured by printing and baking low softening-point glass. It has been considered that the wear of the film takes place due to the difference in the outer shape (the friction coefficient) and that in the hardness between the glassy layer and the film. To prevent wear of the heat-resisting film, made of polyimide for example, a filler has been mixed with the polyimide film, or Teflon coating or the like is performed to reduce the friction coefficient with respect to the insulating protective film 6. However, a satisfactory effect has not been obtained. At present, the foregoing heat fixing method cannot raise the image fixing speed and enlarge the volume of images that can be fixed. Therefore, a desire for lengthening the life (the length of the contact and sliding) of the heater has been raised.

SUMMARY OF THE INVENTION

An object of the present invention is to provide a heating member having a lubricating and protective layer capable of preventing wear of a heat-resisting film that performs a contact and sliding operation.

Another object of the present invention is to provide a heating member having a firmly bonded lubricating and protective layer.

Another object of the present invention is to provide a heat fixing apparatus capable of exhibiting excellent wear resistance and sliding characteristics for a long time.

According to one aspect of the present invention, there is provided a heating member comprising a lubricating and protective layer on the surface thereof, wherein the lubricating and protective layer is a vapor deposited layer which is made of carbon or the main component of which is carbon; and the lubricating and protective layer is formed on a separation-preventive layer for preventing separation of the lubricating and protective layer.

According to another aspect of the present invention, there is provided a heat fixing apparatus comprising a heating member of the foregoing type and a heat-resisting film that comes in contact with and slides along the heating member.

Since the heating member according to the present invention has the lubricating and protective layer on the separation-preventive layer thereof, separation of the lubricating and protective layer from the heating member can be prevented even after the heat fixing apparatus has been used for a long time. Therefore, the effect of preventing wear of the heat-resisting film can be maintained for a long time.

Other and further objects, features and advantages of the invention will be evident from the following detailed description of the preferred embodiments in conjunction with the attached drawings.

PREFERRED EMBODIMENTS OF THE INVENTION

A vapor deposited layer, which is made of carbon or the main component of which is carbon, for use as the lubricating and protective layer for the heating member is exemplified by a hydrogenated amorphous carbon layer (hereinafter an "a-C:H layer), a diamond-like carbon layer (hereinafter called a "DLC layer"), a diamond layer and a hard carbon layer. The foregoing layers can be formed by a vapor-deposition method.

The a-C:H layer and the DLC layer have representative physical properties such that the heat conductivity is 200 to 600 W/m·K, the electric resistance (the volume resistivity) is $10^8$ to $10^{11}$ Ωcm, the hardness is 2,000 to 5,000 kg/mm$^2$ and the friction coefficient μ is 0.2 or smaller. The hard carbon layer has an amorphous structure from a broad point of view and is composed of carbon atoms, which are sp$^2$- and sp$^3$-bonded, the hard carbon layer containing substantially no hydrogen therein. Even if it contains hydrogen, the quantity is less than 1 atom %. The density of the hard carbon layer is higher than the density (2.26 g/cm$^3$) of graphite, but the density is lower than that of diamond (3.15 g/cm$^3$). The hard carbon layer has representative physical properties such that the hardness is 2,000 to 5,000 kg/mm$^2$, the friction coefficient μ<0.2 and the electric resistance (the volume resistivity) is $10^5$ to $10^{11}$ Ωcm. The diamond layer exhibits excellent crystallizing characteristics and contains amorphous carbon and graphite crystal in a small quantity. The diamond layer has representative physical properties such that the hardness is 2,000 to 10,000 kg/mm$^2$, the friction coefficient μ<0.2 and the electric resistance (the volume resistivity) is $10^5$ to $10^{13}$ Ωcm.

Figure 1:
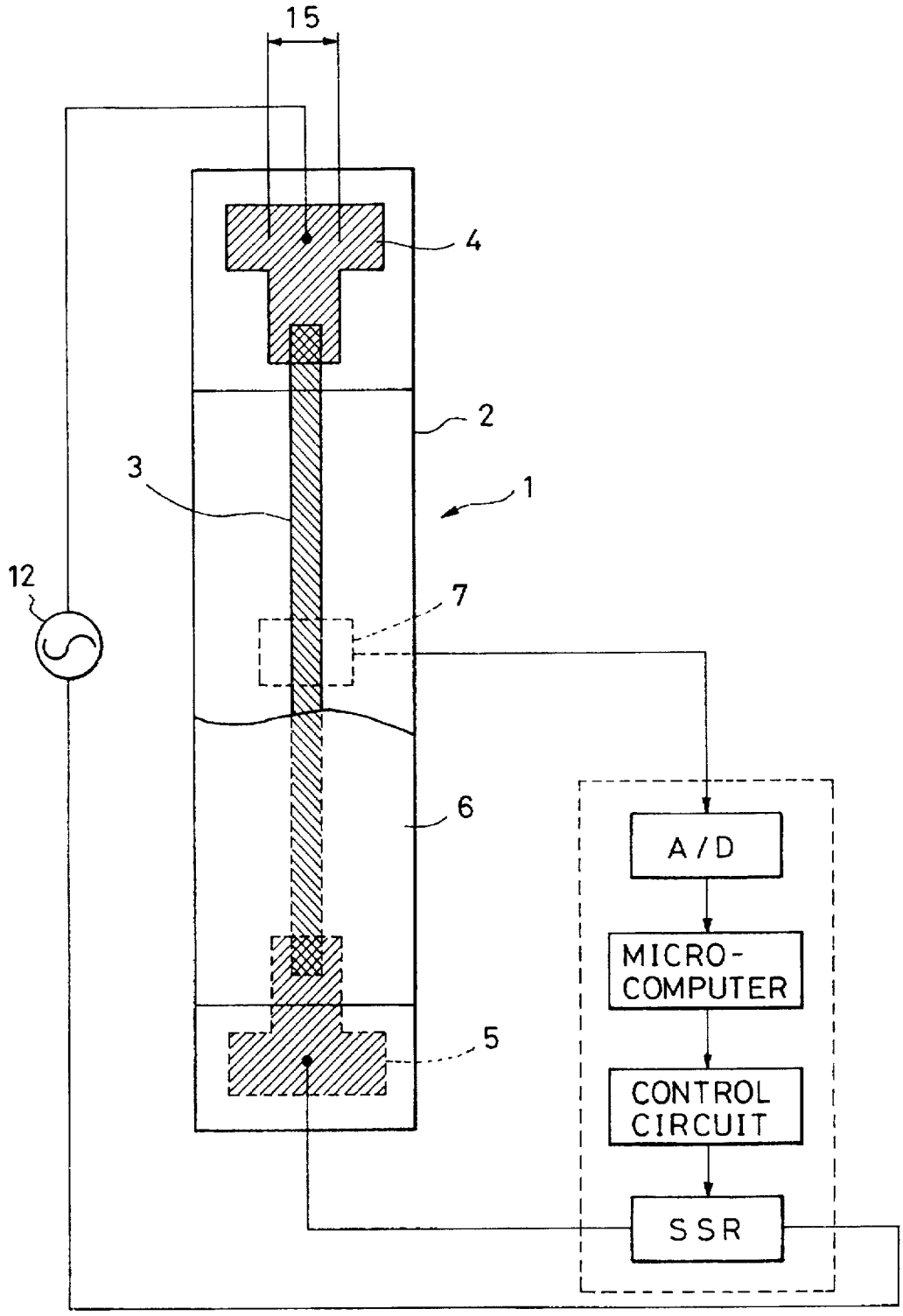
FIG. 1 is a plan view of a heating member for use in a heat fixing apparatus.
Figure 2:
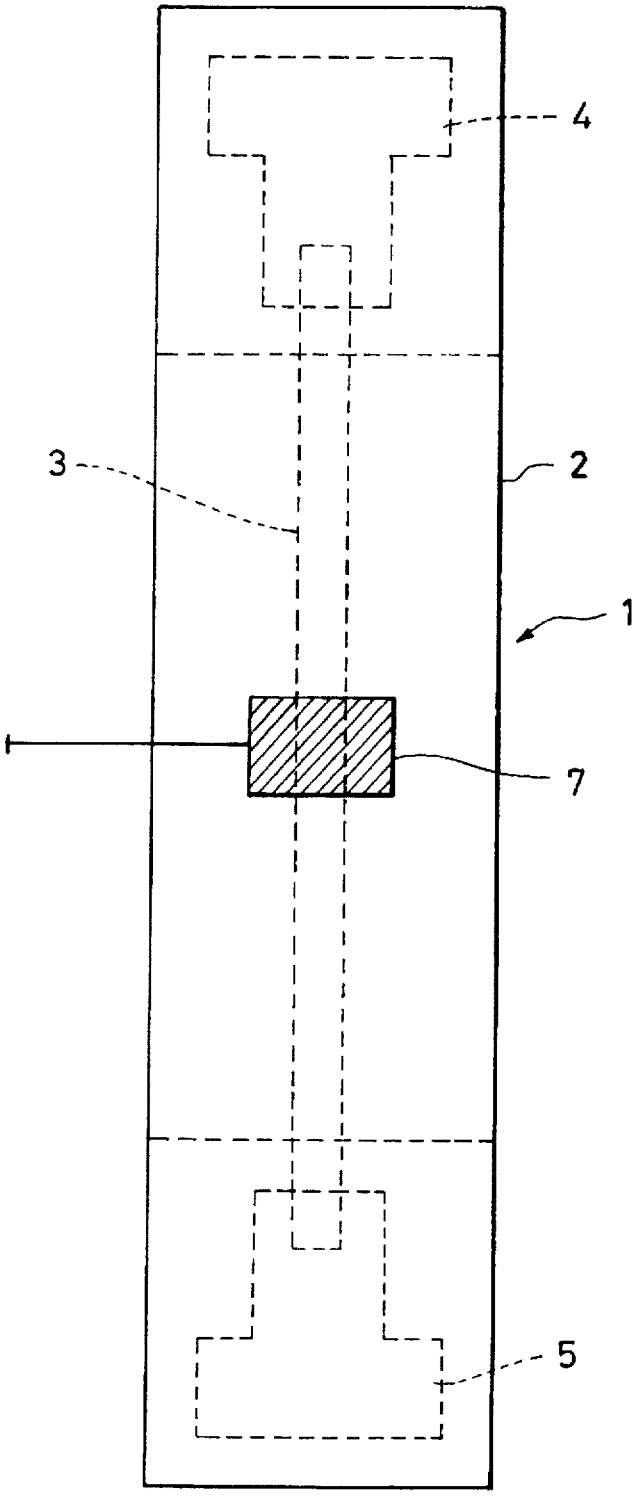
FIG. 2 is a schematic view of the heating member shown in FIG. 1.
Figure 3:
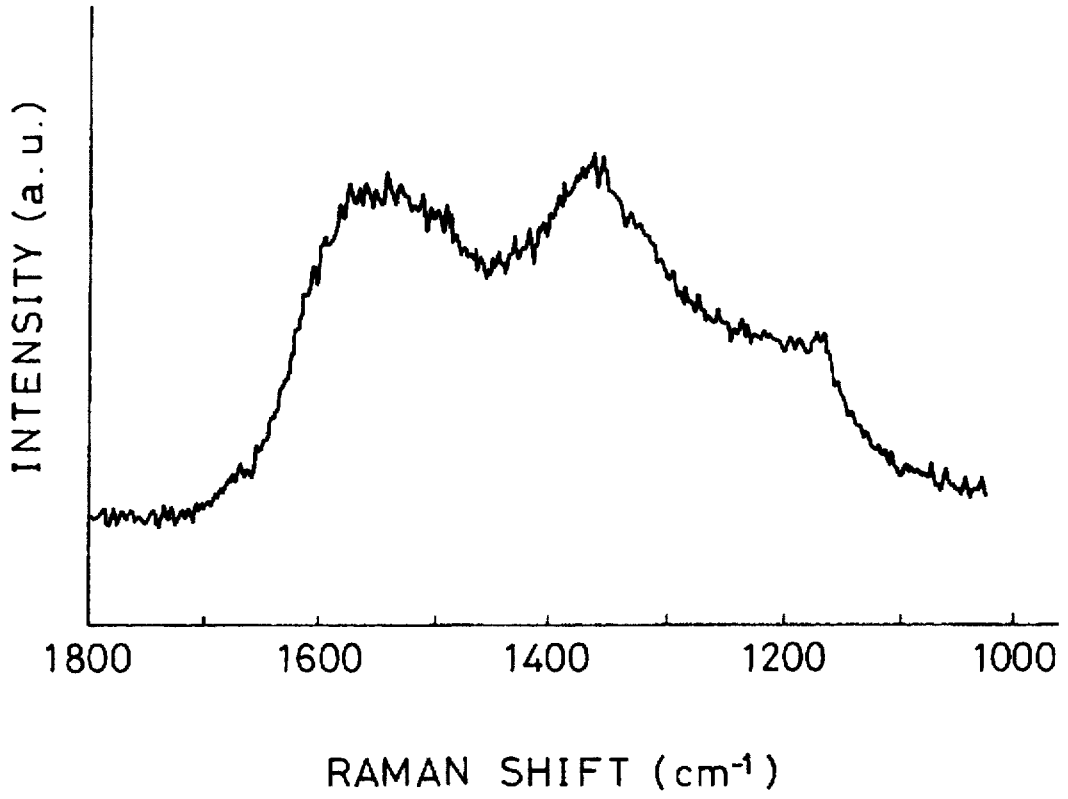
FIG. 3 is a Raman spectrum graph of a vapor deposited layer for use in the present invention.
Figure 4:
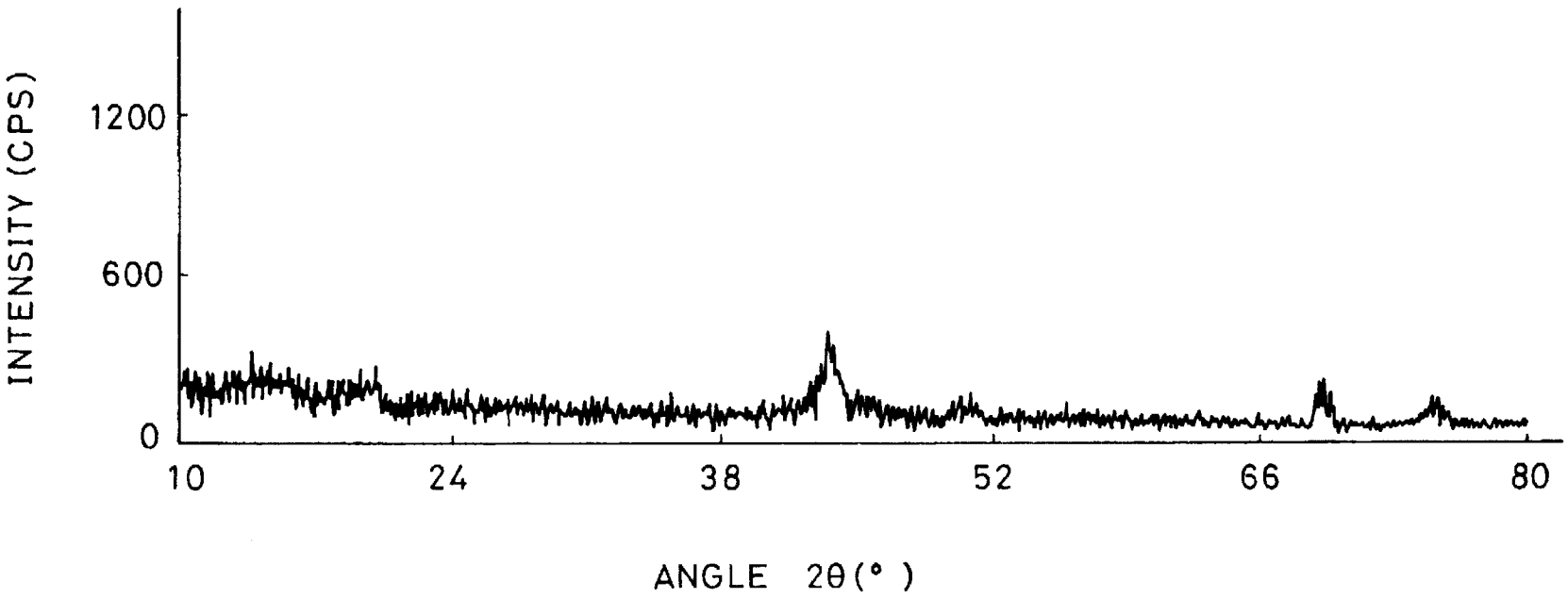
FIG. 4 is an X-ray diffraction graph of the vapor deposited layer for use in the present invention.

The a-C:H layer and the DLC layer can be formed by a method selected from the group consisting of a microwave plasma CVD method, a direct-current plasma CVD method, Radio-frequency plasma CVD method, a magneto-active microwave plasma CVD method, an ion-beam sputtering method, an ion beam deposition method, an ion plating method, a reactive plasma sputtering method, an ion implantation method and a laser plasma CVD method. A raw material gas for use in the employed method is gas containing carbon and of a substance selected from the group consisting of hydrocarbon, such as methane, ethane, propane, ethylene, benzene or acetylene; halogenated hydrocarbon, such as methylene chloride, carbon tetrachloride, chloroform or trichloroethane; alcohol, such as methyl alcohol or ethyl alcohol; ketone, such as $(CH_3)_2CO$ or $(C_6H_5)_2Co$; CO or $CO_2$ gas; and a mixture of any of the foregoing gases and gas selected from the group consisting of $N_2$, $H_2$, $O_2$, $H_2O$ and Ar. As a solid carbon source, pure graphite or glass-type carbon may be used. The hard carbon layer can be formed by a method selected from the group consisting of a plasma sputtering method, an ion beam sputtering method, an ion beam evaporating method, an ion beam mixing method, an ion plating method, a cluster ion beam method, an ion injection method, an arc discharge method and a laser evaporating method. As the starting material to be used in a case where an assist ion beam is used, as well He, $N_2$, $H_2$, $O_2$, $H_2O$, Ar, Ne, Kr or Xe gas is used. Similarly, the diamond layer is formed by a method selected from the group consisting of: a microwave plasma CVD method, a direct-current plasma CVD method, a high-frequency plasma CVD method, a magnetic-field microwave plasma CVD method, an ion beam sputtering method, an ion beam evaporating method, a reactive plasma sputtering method, a laser plasma CVD method, a hot filament CVD method, a plasma jet method (DC or RF) and a combustion flame method. The foregoing gas or a solid source is used as the raw material for use in any of the selected method. The diamond layer composed of a mixed material, consisting of diamond crystal, graphite crystal and amorphous carbon, can be specified by the Raman spectrum shown in FIG. 3 or by X-ray diffraction shown in FIG. 4. That is, a Raman line is observed adjacent to 1550 cm$^{-1}$ generated due to double-bonded carbon, a Raman line is observed adjacent to 1360 cm$^{-1}$ generated due to random graphite microcrystal, and a Raman line is observed adjacent to 1150 cm$^{-1}$ generated due to the polyene structure. Furthermore, a fine Raman line is observed adjacent to 1333 cm$^{-1}$ generated due to diamond. On the other hand, the X-ray diffraction enables a diffraction line generated due to diamond microcrystal to be observed adjacent to 2θ=44°. The surface roughness of the foregoing layer is superior to that of the polycrystal diamond layer because it contains amorphous carbon, the maximum surface roughness of the foregoing layer being 50 nm or less. The density of the foregoing layer is in a range higher than the density (2.26 g/cm$^3$) of graphite and lower than the density (3.51 g/cm$^3$) of diamond. The concentration of hydrogen in the foregoing layer is 10 atom % or lower. The foregoing layer has typical physical properties such that the hardness is 2,000 to 10,000 kg/mm$^2$, the friction coefficient μ<0.2 and the electric resistance (the volume resistivity) is $10^5$ to $10^{11}$ Ωcm. As the graphite crystal and the amorphous carbon component increase in the layer, the hardness, the electric resistance and the heat conductivity of the layer deteriorate. Therefore, it is preferable that the graphite crystal and the amorphous carbon component in the layer be small so far as the surface roughness does not deteriorate. In particular, it is preferable that the graphite crystal component be excluded.

The a-C:H layer and the DLC layer contain hydrogen therein by tens of atom %, and the content of hydrogen makes the characteristics of the layer to be different considerably. For example, the layer of a type containing hydrogen by 50 atom % or more has a large optical band gap, is transparent and has intense electric resistance. However, the layer is a polymer-like layer because it has weak hardness and low heat conductivity. On the other hand, a layer of the type containing hydrogen by 10 to 45 atom % is a very hard layer because it has Vickers hardness of 2,000 to 5,000 kg/mm$^2$. Furthermore, its electric resistance is $10^9$ Ωcm or more, the heat conductivity is 200 W/m·K or more and the friction coefficient is 0.2 or smaller. As described above, the layer of the foregoing type is a layer exhibiting excellent heat conductivity, insulating characteristics and hardness. It is considered that the foregoing characteristics are due to the sp$^3$ bonds present in the layer by 40% to 70% in the layer. Therefore, an a-C:H layer or a DLC layer of the type containing hydrogen by 10 atom % to 45 atom % is used as the lubricating and protective layer according to the present invention. It is difficult to clearly distinguish the a-C:H layer and the DLC layer from each other. Both of the foregoing layers are amorphous layers from a broad point of view, contain hydrogen therein, and are composed of sp$^2$-bonded carbon and sp$^3$-bonded carbon, the two layers having similar physical properties. The DLC layer according to the present invention has a crystal structure of diamond when observed microscopically, that is, the DLC layer has a diffraction pattern that is specified as diamond in a diffraction using electron beams.

By forming a hard and low friction coefficient a-C:H layer, a DLC layer, a diamond layer or a hard carbon layer on the insulating protective film on the heat-generating resistor 3 of the heating device, the problem of tribology experienced with the conventional technology can be overcome. However, the foregoing vapor deposited layers have satisfactory hardness, but contact with the ground is unsatisfactory because of the intense internal stress (the compressive stress). In a particular case where the foregoing vapor deposited layer is formed on a glass plate that constitutes the insulating protective layer, the internal stress (the compressive stress) inhibits sufficient contact, as well as resulting in unsatisfactory wear resistance. It can be considered that the foregoing problems are due to limitation of the combination between $SiO_2$ in the glass plate and carbon atoms in the vapor deposited layer due to alkali metal oxides and other additives in the glass plate. Therefore, the layers are sometimes undesirably separated from each other when the film slides. The foregoing trend becomes apparent if the layer is thickened. Thus, a difficulty occurs in thickening the layer to improve the wear resistance.

In order to overcome the foregoing problem, it is effective to form the vapor deposited layer on a separation-preventive layer. To form the foregoing separation-preventive layer, any of the following materials may be used.

(1) An element selected from the group IVB (Ti, Zr and Hf), group VB (V, Nb and Ta) and group VIB (Cr, Mo and W) in the periodic table.

(2) An oxide, a carbide, a nitride, a carbon nitride, a carbon oxide or a carbonate nitride of the element selected from the foregoing groups.

(3) A boride or a boron nitride of any of the elements selected from the foregoing groups except boron.

(4) A compound containing at least a plurality of the elements selected from the foregoing groups (for example, an oxide or nitride containing Si and Al).

(5) A mixed substance of a plurality of the substances exemplified in (1) to (4).

The foregoing substances can easily be combined with carbon atoms (establishing excellent contact with the same). Therefore, a substance that can easily be combined with (that is, capable of establishing excellent contact with) the main component elements of the material for the ground may be selected from among the foregoing substances. The thickness of the separation-preventive layer can be minimized to a preferred range from 10 Å to 5,000 Å. Furthermore, since the internal stress of the vapor deposited layer is compressive stress, it is ideal that the separation-preventive layer is composed of a substance, the internal stress of which is tensile stress. The separation-preventive layer can be formed by an EP evaporating method, a sputtering method, an ion plating method or the like that is performed independently (individually) from forming of the vapor deposited layer, or the separation-preventive layer and the vapor deposited layer may be formed consecutively in an apparatus for forming the vapor deposited layer which includes an EB evaporating apparatus.

A second method of forming the separation-preventive layer will now be described. With this method, a mixed layer of the material forming the ground layer of the separation-preventive layer and that forming the vapor deposited layer is formed into the separation-preventive layer. The foregoing mixed layer has a concentration gradient such that the concentration of carbon atoms is high in a region adjacent to the vapor deposited layer and that of carbon atoms is low in a region adjacent to the ground layer; and the concentration of the elements forming the ground layer is high in the region adjacent to the ground layer and that of the same is low in the region adjacent to the vapor deposited layer. The thickness of the mixed layer is required to be 1 nm or thicker and as well 100 nm or thinner. If the thickness is thinner than 1 nm, a satisfactorily mixed layer cannot be formed, and therefore the contact characteristic deteriorates. If the mixed layer is too thick, for example, thicker than 100 nm, the stress of the layer is strengthened excessively to prevent separation of the layer.

The mixed layer is formed by an ion beam evaporating method, an ion plating method, an ion beam mixing method or an ion injection method.

The separation-preventive layer can be formed by a third method comprising the step of changing the composition in a boundary region between the separation-preventive layer and the lubricating and protective layer. In an example case where the ground layer of the separation-preventive layer is made of glass which is the insulating protective layer, the concentration of oxygen is gradually lowered while forming the $SiO_2$ layer, which is the main component substance for the glass. On the contrary, the concentration of carbon is raised. Thus, the composition is changed from the $SiO_2$ layer to a SiC layer. Then, the concentration of Si is lowered to control the composition so as to form the vapor deposited layer. That is, the composition in each boundary portion among the ground layer, the separation-preventive layer and the vapor deposited layer is made continuous gradient so that the combination among the layers is strengthened.

A fourth method for forming the separation-preventive layer is characterized in that the separation-preventive layer also serves as the vapor deposited layer, and the concentration of hydrogen contained in the foregoing vapor deposited layer is made higher than that of hydrogen contained in the lubricating and protective layer. For example, an a-C:H layer and DLC layer are formed such that an a-C:H layer or a DLC layer to serve as the separation-preventive layer, in which the concentration of hydrogen is high, is formed on the ground layer; and then an a-C:H layer or a DLC layer to serve as the lubricating and protective layer, in which the concentration of hydrogen is low, is formed. The separation-preventive layer of the foregoing type may consist of two layers in which the concentrations of hydrogen are different from each other. As an alternative to this, the concentration of hydrogen in the layer may be lowered continuously. As described above, the characteristics of the a-C:H layer and DLC layer are made considerably different dependending upon the concentration of contained hydrogen. In particular, although a layer containing hydrogen at a high concentration has relatively weak hardness, it has a weak internal stress. On the other hand, a layer containing hydrogen at a low concentration is hard, but it has intense internal stress. Therefore, a relatively soft layer having small internal stress and formed between the ground layer and the a-C:H layer or the DLC layer enables the intense internal stress of the layer to be absorbed and adjusted. The content of hydrogen in the layer containing hydrogen at a high concentration is 45 atom % to 60 atom %, while that in the layer containing hydrogen at a low concentration is 5 atom % to 45 atom %. With the foregoing method, the contact between the vapor deposited layer and the ground layer can be improved.

Each of the a-C:H layer and the DLC layer has a very low friction coefficient (μ) of 0.02 in a vacuum or dry nitrogen atmosphere. The friction coefficient is enlarged as the relative humidity rises. Although their friction coefficients are usually $\mu<0.2$, the friction coefficient deteriorates in a state where the relative humidity is high or as the length of contact and sliding is lengthened. As contrasted with this, an a-C:H layer or a DLC layer of a type containing Ta, W, Mo, Nb, Ti, Cr, Fe, B, Si or fluorine is enabled to have a friction coefficient that is not affected by humidity or the length of contact and sliding. The concentration of the selected element in the layer is required to be 30 atom % or lower. If the concentration is higher than 30 atom %, the characteristics peculiar to the a-C:H layer or the DLC layer deteriorate. In particular, the hardness of the layer deteriorates excessively in the foregoing case, and, moreover, satisfactory contact with the substrate cannot be established. The reason why the a-C:H layer or the DLC layer of the type containing the foregoing elements has a constant friction coefficient regardless of the environment (in particular, the humidity) and a state of use (the length of contact and sliding) has not been clarified yet. However, an estimation can be performed that dangling bonds present in the a-C:H layer and the DLC layer are terminated by the foregoing elements, and thus the dangling bonds are decreased. Thus, a layer, which is stable with respect to the environment and the state of use, can be formed.

As an alternative to forming the vapor deposited layer on only the insulating protective layer of the heating member, it may be further formed on the heat-generating resistor, the heat-resisting film or the heater holder by the foregoing method. The thickness of the vapor deposited layer is required to be 5 nm to 20 μm in a case where it is formed on the insulating protective layer or the heat-generating resistor, preferably 50 nm to 2 μm. If the thickness is less than several nm, satisfactory lubricating and insulating performance cannot be attained. If the thickness exceeds 20 μm, the stress of the layer causes the layer to be easily separated from the substrate. When the vapor deposited layer is formed directly on the heat-generating resistor, satisfactory insulating characteristics must be attained (to obtain a desired electric resistance). If the vapor deposited layer is formed on the heat-resisting film, it is preferable that the thickness be 5 nm to 200 nm. If the thickness is less than several nm, satisfactory lubricating performance cannot be attained. If the thickness exceeds hundreds of nm, the stress of the layer causes the layer to be separated from the heat-resisting film or the heat-resisting film to be curled. Even if the heat-resisting film curls in a case where the layer has the foregoing preferred thickness, the layer is required to be formed on each side of the heat-resisting film.

When the lubricating and protective layer according to the present invention is formed on the heating member and the heater holder, with which the heat-resisting film comes in contact and along which the same slides, and when the same is formed on the heat-resisting film that comes in contact with and slides along the heating member, the contact and sliding characteristics between the heating member and the heat-resisting film can be further improved.

EXAMPLES

Referring to the drawings, examples of the present invention will now be described.

Example 1

Figure 5:
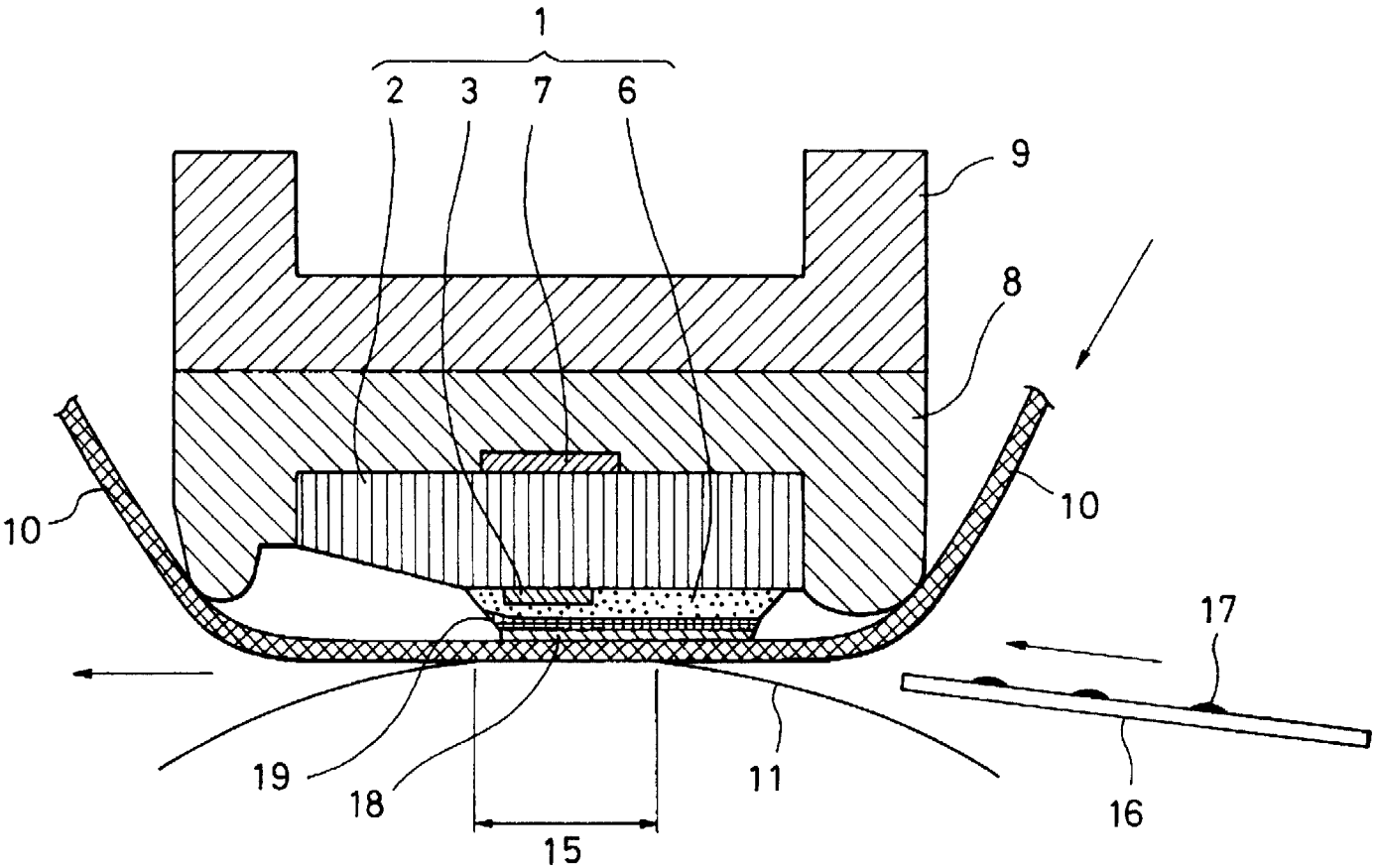
FIG. 5 is a cross sectional view of a portion of the heat fixing apparatus according to an embodiment of the present invention.
Figure 6A:
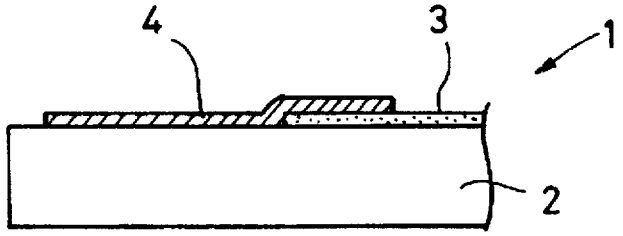
FIGS. 6(*a*)–6(*e*) are cross sectional views of a portion of a heating member according to an embodiment of the present invention.
Figure 6B:
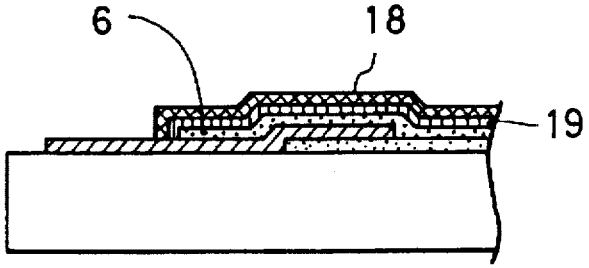
Figure 6C:
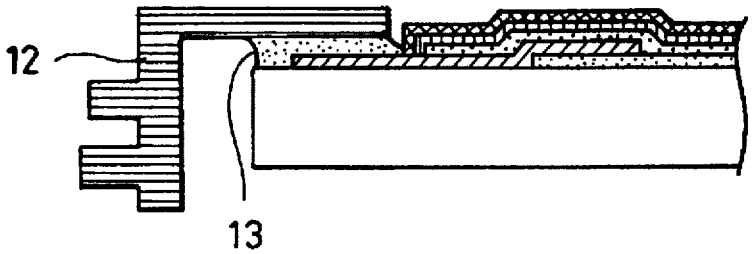
Figure 6D:
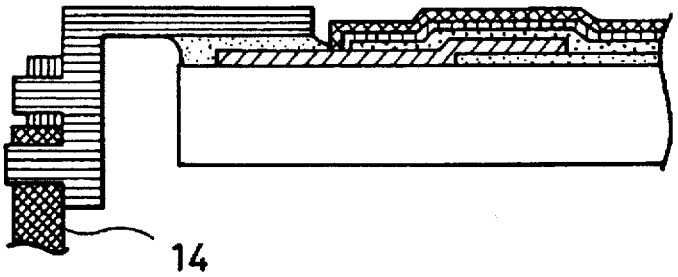
Figure 6E:
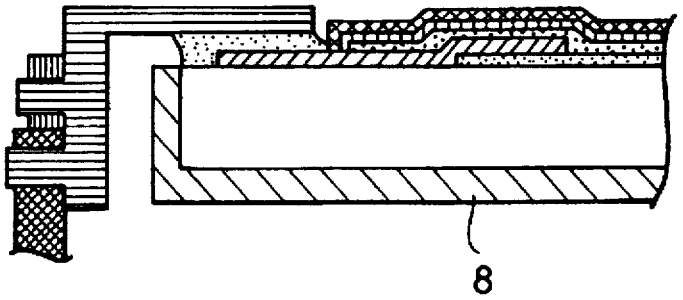

FIG. 5 is an enlarged cross sectional view of a portion of a heat fixing apparatus according to the present invention. A heater 1 is secured to and supported by a heater support portion 9 through a heat-insulating heater holder 8. Reference numeral 10 represents an endless-belt-shape or elongated web-shape heat-resisting film having a thickness of, for example, about 40 μm and made of polyimide. Reference numeral 11 represents a rotative pressurizing roller serving as a pressurizing member that presses the film 10 against the heater 1. The film 10 is, by a drive member (not shown) or the rotational force of the pressurizing roller 11, rotatively moved or is conveyed at a predetermined speed in a predetermined direction while being brought into contact with the edge portion of the heater holder 8 in a state where the film 10 comes in contact with the surface of the heater 1 in a closed manner. When electric power is supplied to a heat-generating resistor 3 of the heater 1, the heater 1 is heated to a predetermined level. When a recording member 16, serving as a member to be heated, is introduced into a fixing nip portion 15 in which the film 10 has been moved and in a state where the surface of the recording member 16 on which a pre-fixed toner image is formed, and faces the surface of the film 10, the recording member 16 passes through the fixing nip portion 15 together with the film 10, while being brought into contact with the surface of the film 10. During the foregoing passage, heat energy is supplied from the heater 1 to the recording member 16 through the film 10 so that a pre-fixed toner image 17 is heated, melted and fixed onto the recording member 16.

FIGS. 6(*a*)–(*e*) are is a cross sectional views schematically showing a portion of a heater according to Example 1 of the present invention. Referring to FIGS. 6(*a*)–(*e*), reference numeral 1 represents a heater, 2 represents a ceramic substrate, 3 represents a heat-generating resistor made of Ag/Pd, 4 and 5 represent electrode terminals made of Cu, 6 represents a glassy insulating protective layer, 18 represents a DLC layer, 8 represents a heater holder, 12 represents an electrode tab, 13 represents a soldering material made of AuSi, 14 represents a wire, and 19 represents a separation-preventive layer.

Figure 7:
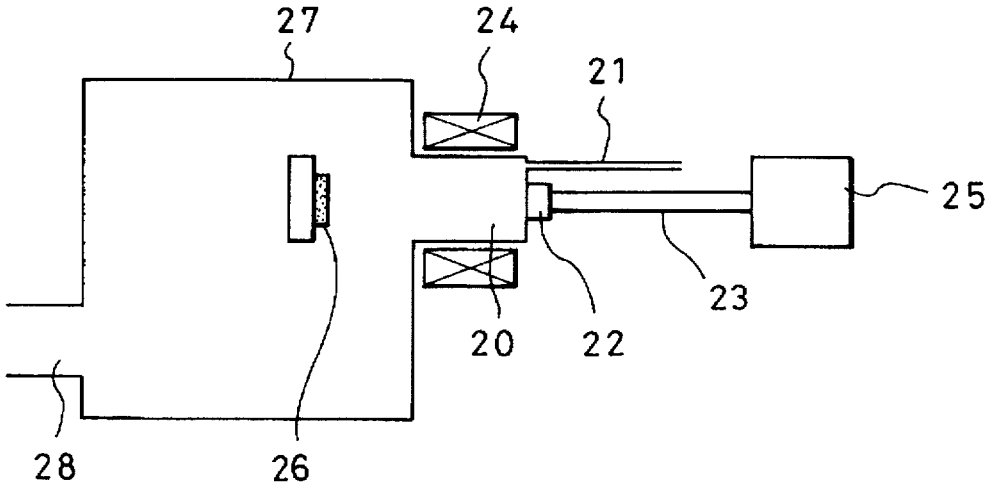
FIG. 7 is a schematic view of an ECR plasma CVD apparatus for forming a DLC layer according to an embodiment of the present invention.

The heater 1 according to this embodiment was manufactured as follows: initially, paste made of Ag/Pd was applied to the $Al_2O_3$ substrate 2 by screen printing to form the heat-generating resistor 3, followed by being baked in the atmosphere. The resistance value of the heat-generating resistor 3 was measured, and then the heat-generating resistor 3 was trimmed to realize a desired resistance value. Then, Cu-paste was applied by screen printing so that the electrode terminals 4 and 5 were formed by baking in a state where attention was paid to the divided pressure of oxygen. Then, low-melting-point lead silicate type glass was applied by screen printing to serve as the insulating protective film 6, followed by being baked in the atmosphere. Then, an a-C:H layer serving as the separation-preventive layer 19 having a thickness of 15 nm was formed by an ECR-PCVD method. Then, the DLC layer 18 having a thickness of 500 nm was formed by an ECR-plasma CVD method. FIG. 7 is a schematic view of an ECR plasma CVD apparatus for forming the a-C:H layer and the DLC layer. Referring to FIG. 7, reference numeral 20 represents a plasma chamber of a hollow resonator type, 21 represents a gas introduction system, 22 represents a microwave introduction window, 23 represents a microwave introduction waveguide, 24 represents an electromagnet, 25 represents a microwave oscillator, 26 represents a substrate, 27 represents a vacuum chamber, and 28 represents an exhaust system. The vacuum chamber 27 was evacuated to $1\times10^{-7}$ Torr, and then the gas introduction system was used to introduce $SiH_4$ by 200 ccm and $H_2$ by 40 ccm to make the gas pressure to be $6.0\times10^{-3}$ Torr. Then, a 2.45 GHz microwave was applied by 700 W so that plasma was generated in the plasma chamber 20. At this time, ECR conditions were set by the electromagnet 24 to realize 1200 Gauss at the introduction window 22 and 875 Gauss at the outlet port in the resonant cavity. Furthermore, an external magnetic field was formed to realize 6000 Gauss at the position of the substrate 26. Then, an a-Si layer having a thickness of 15 nm was formed. The temperature of the substrate 26 was set to 350° C. Then, raw material gas consisting of 15 ccm $CH_4$ and 35 ccm $H_2$ was introduced in such a manner that the gas pressure was $3.0\times10^{-3}$ Torr. Then, a microwave was supplied by 1200 W, while voltage of −500 V was applied from a DC power source (not shown) so that the DLC layer 18 having a thickness of 500 nm and shown in FIG. 6 was formed. The DLC layers manufactured under the same conditions were subjected to an analysis of hydrogen concentration by a HFS (Hydrogen Forward Scattering Spectoroscopy) method. As a result, the content of hydrogen was 25 atom %. Furthermore, the hardness of the manufactured layers was measured by a thin-film hardness meter. As a result, the hardness was 3000 $Kg/mm^2$ as a value converted to Vickers hardness. Furthermore, the friction characteristic was evaluated by a Pin-On-Disc method. The measurement was performed in air, the relative humidity of which was 50% in such a manner that a ball (having a diameter of 5 mm) made of bearing steel (SUJ2) was used as the pin, a load of 1.0N was applied and the sliding speed was set to 0.04 m/s. As a result, the friction coefficient was 0.11. When the manufactured DLC layers were slid 20,000 times under the same conditions, no separation of the layer and critical damage, such as a flaw, were observed.

Then, the soldering material 13 made of AuSi was used to solder the electrode tab 12 made of a copper alloy and the ceramic substrate 2 to each other. Then, the wire 14 was connected to the electrode tab 12 with pressure, followed by bonding the heater 1 to the heater holder 8. When the heater 1 was manufactured, Au was flash plated to the surfaces of the electrode terminals 4 and 5 so that the wettability of the soldering material 13 at the time of the soldering operation was improved so that a stable connection was established. As the material for the electrode tab 12, metal, such as covar, 42-alloy or phosphor copper, may be used as well as the copper alloy. It is preferable that the soldering material has a melting point of 250° C. or higher. The soldering material may be AuGe or AuSu, as well as AnSi. In order to prevent oxidation and contamination of the surface of the Cu electrode terminal taking place due to the soldering process, an Au, Ni or Au/Ni layer was formed by flash plating. As a result, soldering was performed more stably. The reason why the Ni layer was formed is that excessive diffusion of Cu into the soldering material must be prevented.

The thus-manufactured heat fixing apparatus was able to prevent friction between the heater and the film and generation of dust of worn film even if the film was slid. Thus, it was able to maintain stable sliding performance for a long time.

When the separation-preventive layer was formed by a metal element selected from the group consisting of Si, B, Al, elements (Ti, Zr and Hf) of group IVB, elements (V, Nb and Ta) of group VB and elements (Cr, Mo and W) of group VIB in the periodic table, an oxide, a carbide, a nitride, a carbon nitride, a carbonate, a carbonate nitride of the foregoing elements, a boride or a boron nitride of the foregoing elements except boron, a compound consisting of at least a plurality of the foregoing elements, and a mixture of a plurality of the foregoing substances, a similar effect to that obtainable from Si was attained.

Example 2

Figure 8:
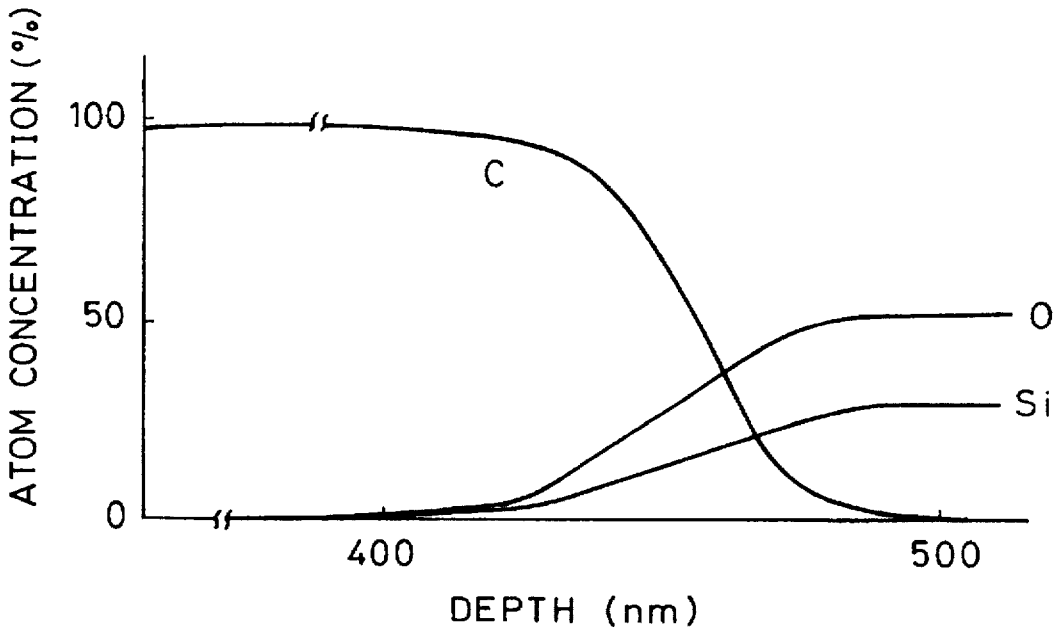
FIG. 8 is a graph of results of analysis of an a-C:H layer according to an embodiment of the present invention by AES in a direction of the depth of the layer.
Figure 9A:
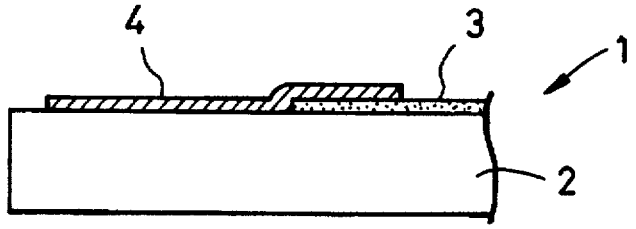
FIGS. 9(*a*)–9(*e*) are cross sectional views of a portion of the heating member according to an embodiment of the present invention.
Figure 9B:
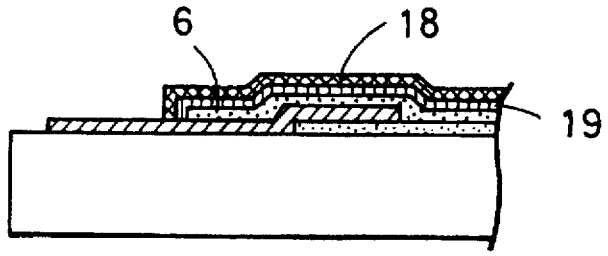
Figure 9C:
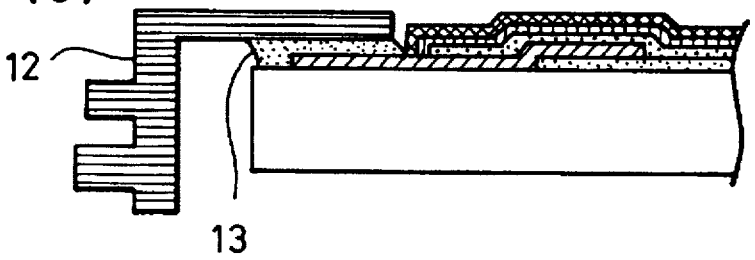
Figure 9D:
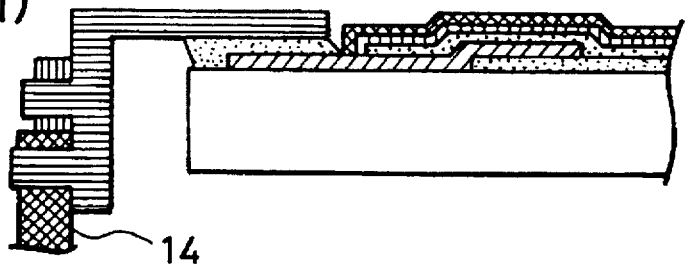
Figure 9E:
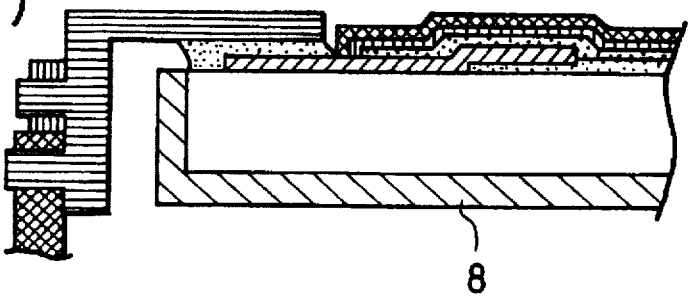

Similarly to Example 1, an a-C:H layer was formed on the insulating protective layer. Similarly to Example 1, the ECR plasma CVD apparatus shown in FIG. 7 was used to evacuate the vacuum chamber 27 to $1\times10^{-7}$ Torr. Then, the gas introduction system 21 was operated to introduce Ar by 30 ccm to make the gas pressure to be $3.0\times10^{-4}$ Torr, followed by supplying a 2.45 GHz microwave by 500 W so that Ar plasma was generated in the plasma chamber 20. At this time, the ECR conditions were set by the electromagnet 24 to realize 1500 Gauss at the introduction window 22 and 875 Gauss at the outlet port in the hollow resonator. Furthermore, an external magnetic field was formed to realize 650 Gauss at the position of the substrate 26. Then, a voltage of −500 V was applied to an extracting electrode (not shown), that is, a grid, disposed at the outlet port of the hollow resonator to irradiate the substrate 26 with an Ar ion beam, the ion electric current density of which was 0.5 $mA/cm^2$, for one minute so that the surface of the substrate 2 was cleaned. Then, $C_2H_2$ in a quantity of 25 ccm and $H_2$ in a quantity of 50 ccm were introduced so that the gas pressure was made to be $4.0\times10^{-4}$ Torr, and then a 2.45 GHz microwave was supplied into the plasma chamber 20 so that plasma was generated in the plasma chamber 20. At this time, the ECR conditions were set by the electromagnet 24 to realize 1500 Gauss at the introduction window 22 and 875 Gauss at the outlet port in the hollow resonator. Furthermore, an external magnetic field was formed to realize 650 Gauss at the position of the substrate 26. Then, voltage of −7 kV was applied to the extracting electrode (not shown), that is, a grid, disposed at the outlet port of the hollow resonator so that ion beams are extracted. Simultaneously, a neutralizer, disposed between the extracting electrode and the substrate 26, was operated to irradiate the substrate 26 with a neutralized ion beam. The foregoing state was maintained for 3 minutes, and then the voltage of the extracting electrode was changed to 700 V. Then, the neutralizer was turned off so that an a-C:H layer having a thickness of 400 nm was formed. Results of analysis of the depth profile of a-C:H layers similarly formed on quartz substrates by AES (Auger Electron Spectroscopy) are shown in FIG. 8. As can be understood from FIG. 8, the thickness of the mixed layer is 50 nm, and the concentration of carbon in the mixed layer is high adjacent to the surface, while the concentration is low adjacent to the substrate 26. On the other hand, the concentration of Si is low adjacent to the surface, while the concentration is high adjacent to the substrate 26. The mixed layer, which was the separation-preventive layer, has the thickness in a range from a value, with which the quantity of change from the maximal value of the concentration of carbon to the minimal value of the same was made to be 50%, to a value with which the concentration of carbon was made to be a maximal value. Then, the electrode tab and the wire were connected to the electrode terminal similarly to Example 1, followed by being bonded to the heater holder portion. Thus, heater sample 1 was manufactured.

A heat fixing apparatus having the thus-manufactured heater mounted thereon was used to fix the recording member with heat similarly to Example 1. As a result, an image could be stably fixed and the fixed image exhibited satisfactory durability, similarly to Example 1.

Example 3

FIGS. 9(*a*)–(*e*) are cross sectional views which schematically show a portion of a heater according to this example. Referring to FIG. 9, reference numeral 1 represents a heater, 2 represents a ceramic substrate, 3 represents a heat-generating resistor made of Ag/Pd, 4 and 5 represent electrode terminals made of Cu, 6 represents a glassy insulating protective layer, 18 represents a vapor deposited layer consisting of diamond crystal, graphite crystal and amorphous carbon, 8 represents a heater holder, 12 represents an electrode tab, 13 represents a soldering material made of AuSi, 14 represents a wire, and 19 represents a separation-preventive layer. The heater 1 according to this embodiment was manufactured such that paste composed of Ag/Pd was, initially, applied to the upper surface of the $Al_2O_3$ by screen printing so as to be the heat-generating resistor 3, followed by being baked in the atmosphere. The resistance value of the heat-generating resistor 3 was measured, and the heat-generating resistor 3 was trimmed to attain a desired resistance value. Then, Cu paste was applied by screen printing so that the electrode terminals 4 and 5 were formed by baking while paying attention to the divided pressure of oxygen.

Then, low-melting-point lead silicate type glass was applied by screen printing to serve as the insulating protective layer 6, followed by being baked in the atmosphere. Then, the separation-preventive layer 19 made of SiC and the DLC layer 18 composed of diamond crystal, graphite crystal and amorphous carbon were formed by the ECR microwave plasma CVD method to respectively have thicknesses of 100 nm and 1 μm. The substrate 2, having the insulating protective film 6 formed thereon, was placed in a magnetic field microwave plasma CVD apparatus. Then, the vacuum chamber was evacuated to $1\times10^{-7}$ Torr, followed by operating a gas introduction system to introduce $SiH_4$ by 20 ccm, $CH_4$ by 20 ccm and $H_2$ by 40 ccm so that the gas pressure was made to be $8.0\times10^{-3}$ Torr. Then, a 2.45 GHz microwave was supplied by 700 W so that plasma was generated in the plasma chamber. At this time, the ECR conditions were set by the electromagnet to realize 1200 Gauss at the introduction window and 875 Gauss at the outlet port in the hollow resonator. Furthermore, an external magnetic field was formed to realize 600 Gauss at the position of the substrate 2. Thus, a SiC layer was formed at a substrate temperature of 500° C. to have a thickness of 100 nm. Then, an ultrasonic wave was applied in an alcohol solution in which diamond abrasive grains having a grain size of 1 μm to 10 μm were dispersed so that a scratching treatment was performed (the density of generated nuclei was $10^9$ to $10^{10}$ pieces/cm$^2$). The substrate 2 was again placed in the apparatus, followed by evacuating the vacuum chamber to $1\times10^{-7}$ Torr. Then, the gas introduction system was operated to introduce $CH_4$ and $H_2$ gases while being adjusted so that the total gas flow rate was made to be 150 ccm $\{CH_4/(H_2+CH_4)\}$: 2 vol %. Thus, the total pressure (the gas pressure) in the vacuum chamber was made to be 50 Torr. Then, a 2.45 GHz microwave was supplied by 2.0 kW so that plasma was generated in the plasma chamber. At this time, an external magnetic field was formed by the electromagnet, which has the ECR conditions set to realize 2000 Gauss at the introduction window and 875 Gauss at the outlet port in the hollow resonator. Furthermore, electric power of 1 kW was supplied from an RF power source (not shown) so that the vapor deposited layer 18 shown in FIG. 9 was formed. At this time, the substrate 2 was located adjacent to the outlet port of the hollow resonator, and the substrate 2 was heated to 500° C. The surface roughness of the layers manufactured under the same conditions was evaluated, resulting in the maximum surface-roughness being 50 nm. The hardness of the formed layer was measured by a thin-film hardness meter. The hardness was 8000 kg/mm$^2$ as a value converted to a Vickers hardness value. Furthermore, the friction characteristic was evaluated by a Pin-On-Disc method. The measurement was performed in air, the relative humidity of which was 45% in such a manner that a ball (having a diameter of 5 mm) made of bearing steel (SUJ2) was used as the pin, a load of 2N was applied and the sliding speed was set to 0.04 m/s. As a result, the friction coefficient was 0.06. Furthermore, analysis was performed by a Raman spectometry method and X-ray diffraction method. As a result, spectrum and diffraction graph like those shown in FIGS. 3 and 4 were obtained. The concentration of hydrogen in the layer was analyzed by a HFS (Hydrogen Forwardscattering Spectometry) method. The concentration of hydrogen was 4 atom % or less.

Then, the electrode tab and the wire were connected to the electrode terminals similarly to Example 1, followed by being bonded to the heater holder portion. Thus, a heater was manufactured. A heat fixing apparatus having the thus-manufactured heater mounted thereon was used to fix the recording member with heat similarly to Example 1. As a result, an image could be stably fixed and the fixed image exhibited satisfactory durability, similarly to Example 1.

Example 4

Figure 10:
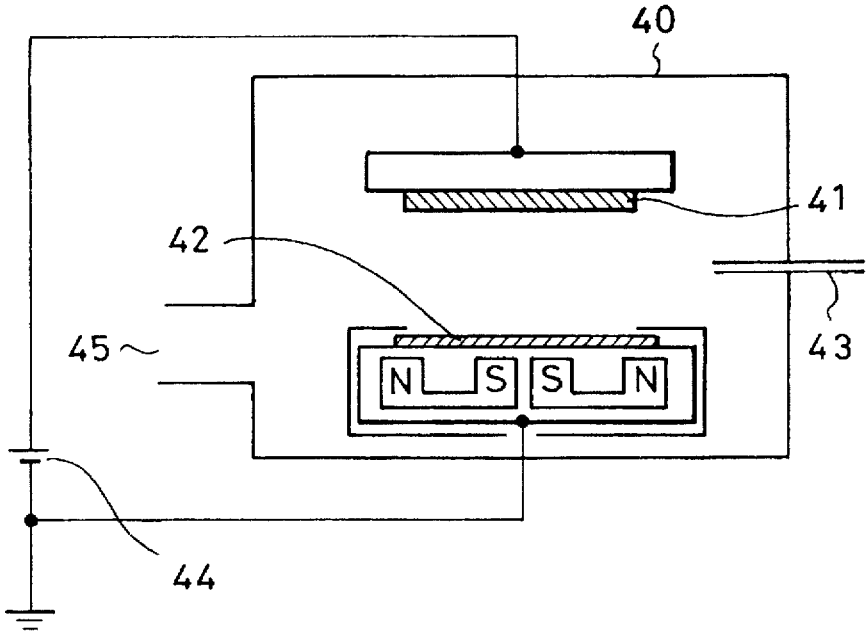
FIG. 10 is a schematic view of a DC magnetron sputtering apparatus used to form a DLC layer according to an embodiment of the present invention.

A heater according to this embodiment was manufactured as follows: initially paste made of Ag/Pd was applied to the $Al_2O_3$ substrate by screen printing to form the heat-generating resistor 3, followed by being baked in the atmosphere. The resistance value of the heat-generating resistor 3 was measured, and then the heat-generating resistor 3 was trimmed to realize a desired resistance value. Then, Cu-paste was applied by screen printing so that the electrode terminals 4 and 5 were formed by baking in a state where attention was paid to the divided pressure of oxygen. Then, low-melting-point lead silicate type glass was applied by screen printing to serve as the insulating protective layer, followed by being baked in the atmosphere. Then, the separation-preventive layer 19 and the vapor deposited layer 18 were formed by a DC sputtering method to have respective thicknesses of 50 nm and 500 nm. FIG. 10 is a schematic view of a DC magnetron sputtering apparatus for forming the DLC layer. Referring to FIG. 10, reference numeral 40 represents a vacuum chamber, 41 represents a substrate, and 42 represents a $SiO_2$ target, the purity of which was 99.99%, and a graphite target. Reference numeral 43 represents a gas introduction system, 44 represents a DC power source, and 45 represents an exhaust system. After the vacuum chamber 40 had been evacuated to $1\times10^{-7}$ Torr, the gas introduction system 43 was operated to introduce Ar so that the gas pressure was made to be 0.9 Pa. At this time, the temperature of the substrate 41 was made to be room temperature, a discharge power of 50 W was supplied, and the distance between the substrate 41 and the target 42 was set to 40 mm. Prior to forming the layer, the target was pre-sputtered with 300 W for 20 minutes. Initially, the $SiO_2$ target was used so that a $SiO_2$ layer having a thickness of 50 nm was formed on the insulating protective film to serve as the separation-preventive layer. Then, the target was reversed to use the graphite target so that a hard carbon layer having a thickness of 500 nm was formed. The concentration of hydrogen in each of layers formed under the same conditions was analyzed by the HFS (Hydrogen Forwardscattering Spectometry) method. As a result, no hydrogen was contained. The hardness of the layer was measured by the thin-film hardness meter. The hardness resulted in 2000 $kg/mm^2$ which was a value converted to a Vickers hardness value. Furthermore, the friction characteristic was evaluated by a Pin-On-Disc method. The measurement was performed in air, the relative humidity of which was 45% in such a manner that a ball (having a diameter of 5 mm) made of bearing steel (SUJ2) was used as the pin, a load of 1.2N was applied and the sliding speed was set to 0.04 m/s. As a result, the friction coefficient was 0.15. Note that the density evaluated by an RBS (Rutherford Backscattering Spectromety) was 2.8 $g/cm^3$.

Then, the electrode tab and the wire were connected to the electrode terminal similarly to Example 1, followed by being bonded to the heater holder portion. Thus, a heater was manufactured. A heat fixing apparatus having the thus-manufactured heater mounted thereon was used to fix the recording member with heat similarly to Example 1. As a result, an image could be stably fixed and the fixed image exhibited satisfactory durability, similarly to Example 1.

Example 5

Similarly to Example 1, a DLC layer was formed on the insulating protective layer. Similarly to Example 1, the ECR plasma CVD apparatus shown in FIG. 7 was used to evacuate the vacuum chamber to $1\times10^{-7}$ Torr. Then, the gas introduction system was operated to introduce Ar by 30 ccm to make the gas pressure to be $3.0\times10^{-4}$ Torr, followed by supplying a 2.45 GHz microwave by 500 W so that Ar plasma was generated in the plasma chamber. At this time, the ECR conditions were set by the electromagnet to realize 1500 Gauss at the introduction window and 875 Gauss at the outlet port in the hollow resonator. Furthermore, an external magnetic field was formed to realize 650 Gauss at the position of the substrate. Then, voltage of −500 V was applied to the extracting electrode (not shown), that is a grid, disposed at the outlet port of the hollow resonator so that the substrate was, for one minute, irradiated with an Ar ion beam, the ion electric current density of which was 0.5 $mA/cm^2$. Thus, the surface of the substrate was cleaned. Then, $SiH_4$ in a quantity of 20 ccm and $O_2$ in a quantity of 40 ccm were introduced so that the gas pressure was made to be $4.0\times10^{-4}$ Torr. Then, a 2.45 GHz microwave was supplied by 1 kW for 3 minutes so that a $SiO_2$ layer was formed to have a thickness of 20 nm to serve as the separation-preventive layer. Then, the flow rate of $O_2$ was gradually decreased, while $CH_4$ and $H_2$ were gradually increased. Thus, the $CH_4$ in a quantity of 20 ccm and $H_2$ in a quantity of 40 ccm were, for 10 minutes, supplied so that a SiC layer having a thickness of 100 nm was formed. Then, the flow of the $SiH_4$ was gradually decreased to 0 ccm. In the thus-realized state, a DLC layer having a thickness of 700 nm was formed similarly to Example 1. A chemical combination state of DLC layers similarly formed on quartz substrates were analyzed by ESCA in the direction of the depth of the layer. As a result, the composition being inclined was confirmed in the sequential order of $SiO_2$, SiC and C (DLC) layers. Furthermore, the concentration of hydrogen in the DLC layer was analyzed by the HFS (Hydrogen Forwardscattering Spectoroscopy) method. In this case, the content of hydrogen was 30 atom %. The hardness of the foregoing layer was measured by the thin-film hardness meter, resulting in a value, converted into a Vickers hardness, of 2500 kg/mm. The Pin-On-Disc method was used to evaluate the friction characteristics. The measurement was performed in air, the relative humidity of which was 50%, in such a manner that a ball (having a diameter of 5 mm) made of bearing steel (SUJ2) was used as the pin, a load of 1.0N was applied and the sliding speed was set to 0.04 m/s. As a result, the friction coefficient was 0.11. The layers were slid 20,000 times under the same conditions and no critical damage, such as separation or flaw, was observed.

Then, the electrode tab and the wire were connected to the electrode terminal similarly to Example 1, followed by being bonded to the heater holder portion. Thus, a heater was manufactured. A heat fixing apparatus having the thus-manufactured heater mounted thereon was used to fix the recording member with heat similarly to Example 1. As a result, an image could be stably fixed and the fixed image exhibited satisfactory durability, similarly to Example 1.

Example 6

Figure 11:
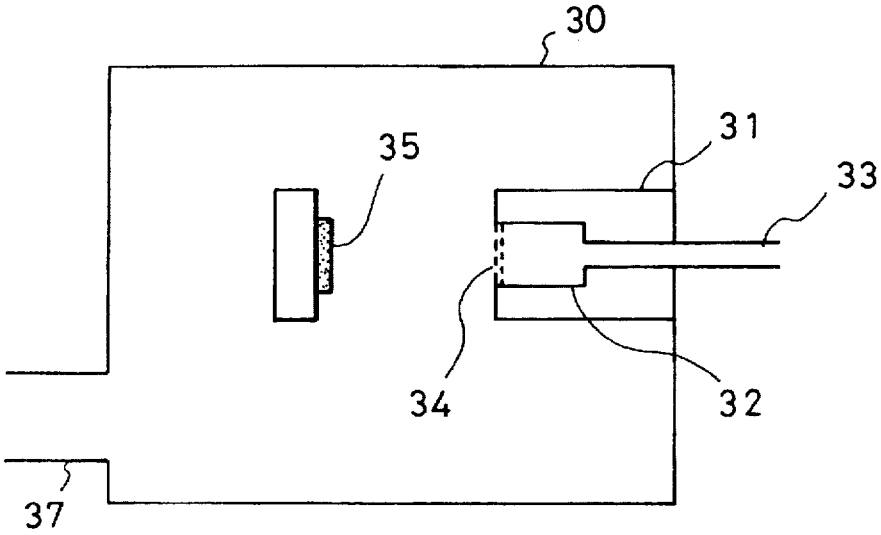
FIG. 11 is a schematic view of an ion beam evaporating apparatus used to form the a-C:H layer according to an embodiment of the present invention.

An a-C:H layer to serve as the separation-preventive layer and the lubricating and protective layer was formed on the insulating protective layer. FIG. 11 is a schematic view of an ion beam evaporating (IBD) apparatus used to form the a-C:H layer. Referring to FIG. 11, reference numeral 30 represents a vacuum chamber, 31 represents an ion beam source, 32 represents an ionizing chamber, 33 represents a gas introduction system, 34 represents an ion beam extracting electrode, 35 represents a substrate, and 37 represents an exhaust system. The vacuum chamber 30 was evacuated to $1\times10^{-7}$ Torr, and then the gas introduction system 33 was used to introduce Ar by 30 ccm in such a manner that the gas pressure was made to be $3.0\times10^{-4}$ Torr. Then, voltage of 500 V was applied to the extracting electrode 34 so that the substrate was irradiated with an Ar ion beam, the ion electric current density of which was 0.5 $mA/cm^2$. Thus, the surface of the substrate was cleaned. Then, $CH_4$ in a quantity of 5 ccm and $H_2$ in a quantity of 40 ccm were introduced from the gas supply system 33 in such a manner that the gas pressure was made to be $2.0\times10^{-4}$ Torr. Then, plasma was generated in the plasma chamber. Then, voltage of 0.6 kV was applied to the extracting electrode 34 to irradiate the substrate with an extracted ion beam so that an a-C:H layer having a thickness of 100 nm was formed. Then, the flow rate of $CH_4$ was gradually increased to 20 ccm, and an a-C:H layer having a thickness of 450 nm was formed. At this time, the substrate was heated to 300° C. The concentrations of hydrogen in a-C:H layers similarly formed on quartz substrates were analyzed by the HFS (Hydrogen Forwardscattering Spectoroscopy) method. The content of hydrogen was 50 atom % adjacent to the substrate, while the same was 30 atom % adjacent to the surface. The hardness of the layer was measured by the thin-film hardness meter. The hardness was 2000 kg/mm$^2$, which was a value converted into a Vickers hardness value. The friction characteristics were evaluated by the Pin-On-Disc method. The measurement was performed in air, the relative humidity of which was 50% in such a manner that a ball (having a diameter of 5 mm) made of bearing steel (SUJ2) was used as the pin, load of 1.0N was applied and the sliding speed was set to 0.04 m/s. As a result, the friction coefficient was 0.11. When the layers were slid 20,000 times under the same conditions, no critical damage, such as separation and flaw of the layer, was observed.

Then, the electrode tab and the wire were connected to the electrode terminal similarly to Example 1, followed by being bonded to the heater holder portion. Thus, a heater was manufactured. A heat fixing apparatus having the thus-manufactured heater mounted thereon was used to fix the recording member with heat similarly to Example 1. As a result, an image could be stably fixed and the fixed image exhibited satisfactory durability, similarly to Example 1.

As described above, according to the present invention, a hard separation-preventive layer is formed when a hard vapor deposited layer having a low friction coefficient is, as the lubricating and protective layer, formed on the insulating protective layer of the heating member with which the heat-resisting film comes in contact and along which the same slides. Thus, a lubricating and protective layer capable of establishing excellent contact can be formed. As a result, a heat fixing apparatus capable of maintaining excellent wear resistance and sliding characteristics for a long time can be provided. According to the present invention, the fixing speed can be raised, and the size of an image that can be fixed can be enlarged. Thus, the running cost can be reduced.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

What is claimed is:

1. A heating member usable with a heater, said heating member comprising:

an insulating protective layer disposed on the surface of the heater;

a separation-preventive layer disposed on said insulating protective layer; and a lubricating and protective layer disposed on said separation-preventive layer, said lubricating and protective layer comprising a vapor deposited layer that is made of carbon or the main component of which is carbon, said separation-preventive layer being provided to impede separation of said lubricating and protective layer from the heater, wherein said separation-preventive layer comprises a substance selected from the group consisting of:

(a) Si;

(b) B;

(c) elements Ti, Zr, and Hf of group IVB of the periodic table;

(d) elements V, Nb, and Ta of group VB of the periodic table;

(e) elements Cr, Mo, and W of group VIB of the periodic table;

(f) an oxide, a carbide, a nitride, a carbon nitride, a carbon oxide, and a carbonate nitride of any of said elements (a)–(e);

(g) a boride and a boron nitride of any of said elements (a) and (c)–(e); and a compound of at least two types of said elements (a)–(e), wherein said separation-preventive layer comprises a vapor deposited layer, and a concentration of hydrogen contained in the vapor deposited layer of said separation-preventive layer is higher than a concentration of hydrogen contained in said lubricating and protective layer.

2. A heating member according to claim 1, wherein said vapor deposited layer comprises a layer selected from the group consisting of a hydrogenated amorphous carbon layer, a diamond-like carbon layer, a diamond layer and a hard carbon layer.

3. A heating member according to claim 2, wherein said diamond layer comprises a polycrystal layer of diamond.

4. A heating member according to claim 2, wherein said diamond layer comprises a mixed layer of diamond crystal, graphite crystal and amorphous carbon.

5. A heating member according to claim 1, wherein a boundary portion between the separation-preventive layer and said lubricating and protective layer comprises a composition that continuously changes in a thickness direction of the separation-preventive layer and said lubricating and protective layer.

6. A heating member according to claim 1, wherein said insulating protective layer comprises a glass layer.

7. A heating member usable with a heater, said heating member comprising:

a separation-preventive layer disposed on the heater; and a lubricating and protective layer disposed on said separation-preventive layer, said lubricating and protective layer comprising a vapor deposited layer that is made of carbon or the main component of which is carbon, said separation-preventive layer being provided to impede separation of said lubricating and protective layer from the heater, wherein said separation-preventive layer comprises a substance selected from the group consisting of:

(a) Si;

(b) B:

(c) elements Ti, Zr, and Hf of group IVB of the periodic table;

(d) elements V, Nb, and Ta of group VB of the periodic table;

(e) elements Cr, Mo, and W of group VIB of the periodic table;

(f) an oxide, a carbide, a nitride, a carbon nitride, a carbon oxide, and a carbonate nitride of any of said elements (a)–(e);

(g) a boride and a boron nitride of any of said elements (a) and (c)–(e); and a compound of at least two types of said elements (a)–(3); and wherein said separation-preventive layer comprises a vapor deposited layer, and a concentration of hydrogen contained in the vapor deposited layer of said separation-preventive layer is higher than a concentration of hydrogen contained in said lubricating and protective layer.

* * * * *

UNITED STATES PATENT AND TRADEMARK OFFICE

CERTIFICATE OF CORRECTION

PATENT NO. : 5,705,272
DATED : January 6, 1998
INVENTOR(S) : Yasushi TANIGUCHI

It is certified that error appears in the above-identified patent and that said Letters Patent is hereby corrected as shown below:

Title Page, [56] References Cited, after "4,840,388", delete "6/1989" and insert therefor --9/1989--.

Column 4, line 5, delete "of";
Line 11, after "$)_2$", delete "Co" and insert therefor --CO--;
Line 33, delete "method" and insert therefor --methods--.

Column 5, line 7, delete "$10^9$" and insert therefor --$10^8$--.

Column 7, line 5, delete "dependending" and insert therefor --depending--;
Line 26, delete "is lengthened" and insert therefor --increases--.

Column 8, line 48, delete "is a";

Column 12, line 31, delete "spectometry" and insert therefor --spectrometry--.

UNITED STATES PATENT AND TRADEMARK OFFICE

CERTIFICATE OF CORRECTION

PATENT NO. : 5,705,272

DATED : January 6, 1998

INVENTOR(S) : Yasushi TANIGUCHI

It is certified that error appears in the above-identified patent and that said Letters Patent is hereby corrected as shown below:

Column 15, line 6, after "pin,", insert --a--.

Signed and Sealed this

Seventh Day of July, 1998

Bruce Lehman

*Attest:*

BRUCE LEHMAN

*Attesting Officer*

*Commissioner of Patents and Trademarks*